United States Patent [19]

Aker

[11] 4,455,960

[45] Jun. 26, 1984

[54] FLUID VALVE ACTUATED BOAT THRUSTER

[75] Inventor: Charles M. Aker, Newport Beach, Calif.

[73] Assignee: Omnithruster, Inc., Santa Fe Springs, Calif.

[21] Appl. No.: 319,927

[22] Filed: Nov. 10, 1981

[51] Int. Cl.[3] ..... B63H 25/46

[52] U.S. Cl. ..... 114/151; 440/40; 440/43

[58] Field of Search ..... 251/283, 305, 298, 299, 251/313; 440/40, 43, 38; 114/151

[56] References Cited

U.S. PATENT DOCUMENTS

| | | | |
|---|---|---|---|
| 164,033 | 1/1875 | Pratt | 440/43 |
| 3,040,527 | 6/1962 | Christensen | 440/43 |
| 3,137,266 | 6/1964 | Perrier | 440/43 |
| 3,209,717 | 10/1965 | Campbell | 114/151 |
| 3,492,965 | 2/1970 | Wayfield | 114/151 |
| 3,557,736 | 1/1971 | Baer | 114/151 |
| 4,056,073 | 11/1977 | Dashew | 114/151 |
| 4,138,963 | 2/1979 | Thompson | 114/151 |
| 4,214,544 | 7/1980 | Dashew | 440/40 |

*Primary Examiner*—Sherman D. Basinger

*Attorney, Agent, or Firm*—Freilich, Hornbaker, Rosen & Fernandez

[57] ABSTRACT

An improved boat thruster system including a pump for drawing water through an inlet in the boat hull and for discharging water through first and second pipes connected to outlets located on either side of the hull. A valve is installed in each of the pipes to control the flow of water therethrough. The valves may be controlled by either an open or closed loop control system configured so as to prevent both outlet pipes from being closed at the same time during system operation. Each valve is preferably comprised of multiple vanes each of which is mounted for rotation about an off center axis such that in the event of a valve control system failure, the water flow will cause the valve to open rather than close thereby preventing undesirable high pressure buildup in the system.

4 Claims, 9 Drawing Figures

NEUTRAL THRUST

STARBOARD THRUST

PORT THRUST

FLUID VALVE ACTUATED BOAT THRUSTER

FIELD OF THE INVENTION

This invention relates generally to improvements in boat thruster systems and more particularly to an improved valve control system therefor.

BACKGROUND OF THE INVENTION

Boat thruster systems which utilize pump, pipe and valve arrangements for drawing water in from the sea and selectively discharging water through port and starboard openings in the hull of the boat are well known. Typical systems such as described in U.S. Pat. Nos. 4,056,073 and 4,214,544 employ valves located within such pipes to selectively direct water to the port and/or starboard hull openings. Such systems typically include closed loop valve control systems utilizing feedback circuitry for precisely positioning the valves to achieve various proportions of maximum thrust.

Although open loop valve control systems would be simpler, less expensive, and easier to maintain than closed loop systems, it has been recognized that substantial system damage can occur in the event of a failure which permits both outlet pipe valves to be closed at the same time.

SUMMARY OF THE INVENTION

In view of the foregoing, an improved boat thruster system is provided including a valve control system which may comprise either open or closed loop control means figured so as to assure that at least one water flow path to the sea is open at all times during system operation.

In accordance with one aspect of the invention, a valve control system is provided capable of defining three different thrust states; i.e. starboard thrust, neutral and port thrust, and configured such that the system cannot switch directly from starboard to port thrust, or vice versa, but rather must always pass through the neutral state which causes the valves in both outlet pipes to open.

In accordance with a different aspect of the invention, each outlet pipe valve includes at least one vane mounted for rotation about an axis displaced from the vane center. As a consequence, water flow within the outlet pipe bearing against the vane will force it to its open position unless the pneumatic actuator coupled thereto is forcing it closed.

In accordance with the preferred embodiment, each outlet pipe valve is comprised of multiple vanes for facilitating smooth water flow through the outlet pipe. The outlet pipe valves are driven closed only when the starboard or port thrust states are defined. The valve control system preferably includes an operator control panel, electrically actuated air valves and pneumatic actuators for opening and/or closing the water valves located in the outlet pipes.

DESCRIPTION OF THE PREFERRED EMBODIMENT

Figure 1:
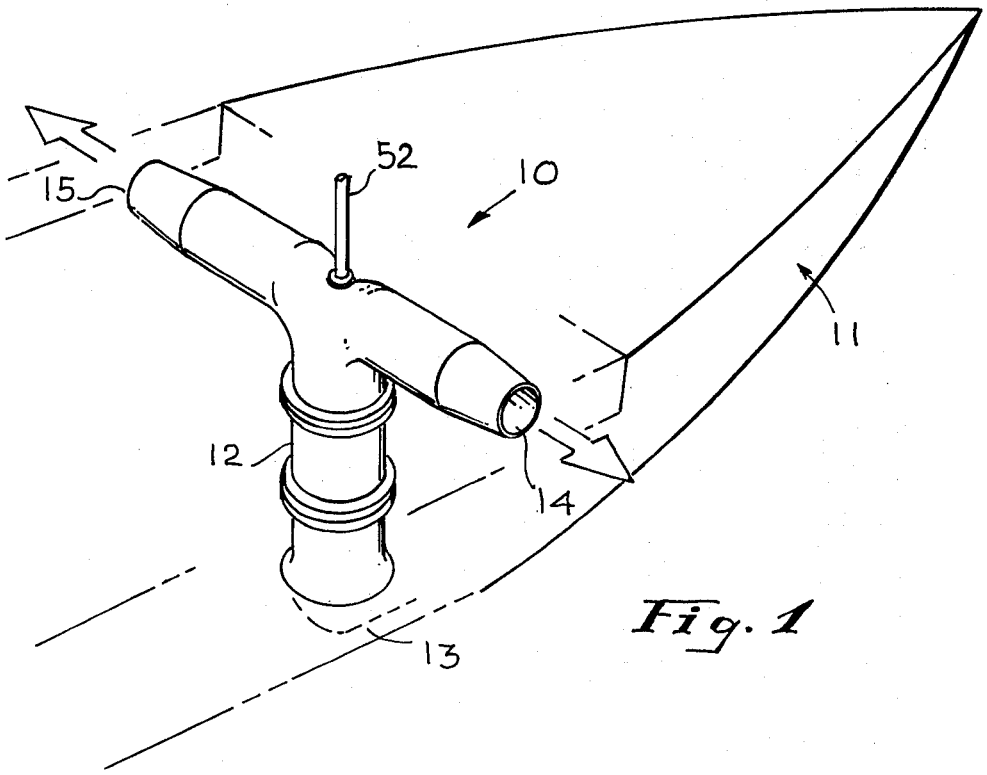
FIG. 1 is a perspective view illustrating a portion of a typical prior art boat thruster installed in the bow of a boat.

FIG. 1 illustrates a typical boat thruster system 10 mounted in the hull of a boat 11 to facilitate the maneuvering thereof. The system includes a shaft driven pump 12 which operates to draw water from the sea through inlet 13 and to selectively discharge the water to the sea through starboard and/or port outlets 14 and 15 located in the hull proximate to the bow.

Figure 2:
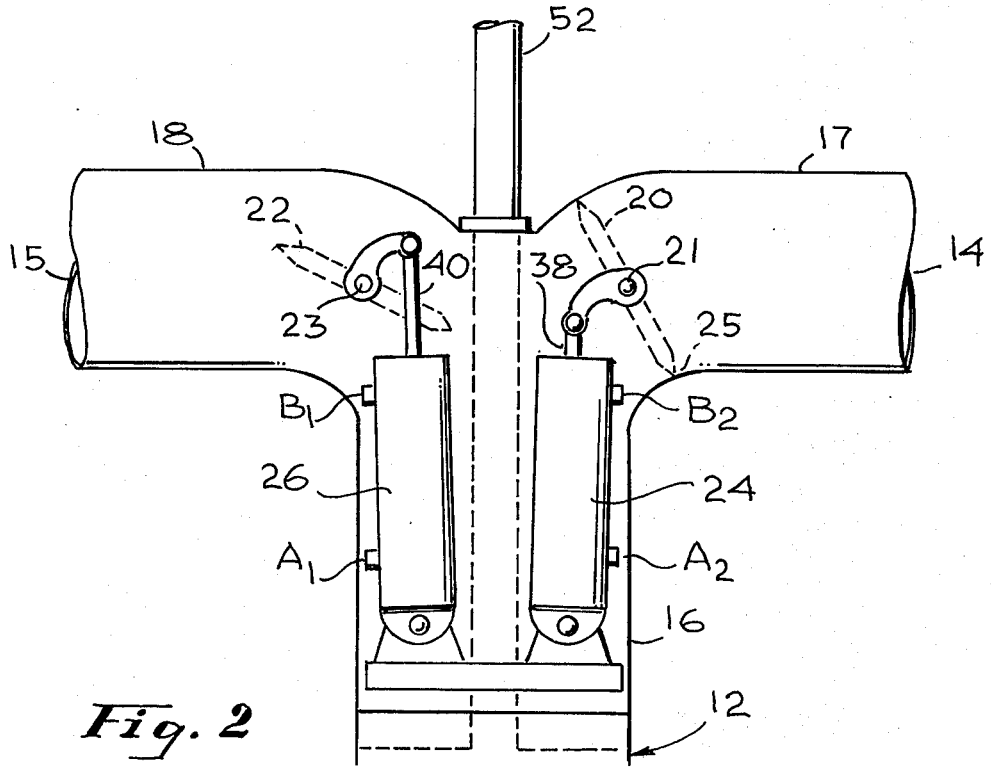
FIG. 2 is a front elevation view of the thruster mechanism of FIG. 1 showing the pneumatic actuators connected to the valve vanes installed in the outlet pipes.

FIG. 2 illustrates the boat thruster system of FIG. 1. A first pipe section 16 supplies water from pump 12 to second and third outlet pipe sections 17, 18 respectively terminating at outlets 14, 15. Pipe sections 17, 18 include valve vanes 20, 22 for respectively controlling the flow of water to outlets 14, 15.

In the use of a thruster system as depicted in FIGS. 1 and 2, the pump is selectively controlled by shaft 52 connected to drive means (not shown) to draw water from the sea through inlet 13. The valve vanes 20, 22 are selectively controlled by pneumatic actuators 24, 26 to direct the water flow from pump 12 to starboard outlet 14 and/or port outlet 15. Water discharge from starboard outlet 14 tends to pivot the bow toward port (port thrust) and discharge from port outlet 15 tends to pivot the bow toward starboard (starboard thrust). Discharge from both port and starboard outlets simultaneously tends to maintain the bow on course (neutral thrust). Although the outlets 14, 15 are illustrated proximate to the bow of boat 11 additional or alternative outlets may also be located at other positions along the hull of the boat.

The pneumatic actuators of FIG. 2 are positioned such that actuator 24 has rotated vane 20 to define a closed state wherein flow of water through outlet pipe 17 is prohibited and actuator 26 has rotated vane 22 to define an open state wherein flow of water through outlet pipe 18 is permitted. This configuration, of course, defines the starboard thrust state.

Figure 3:
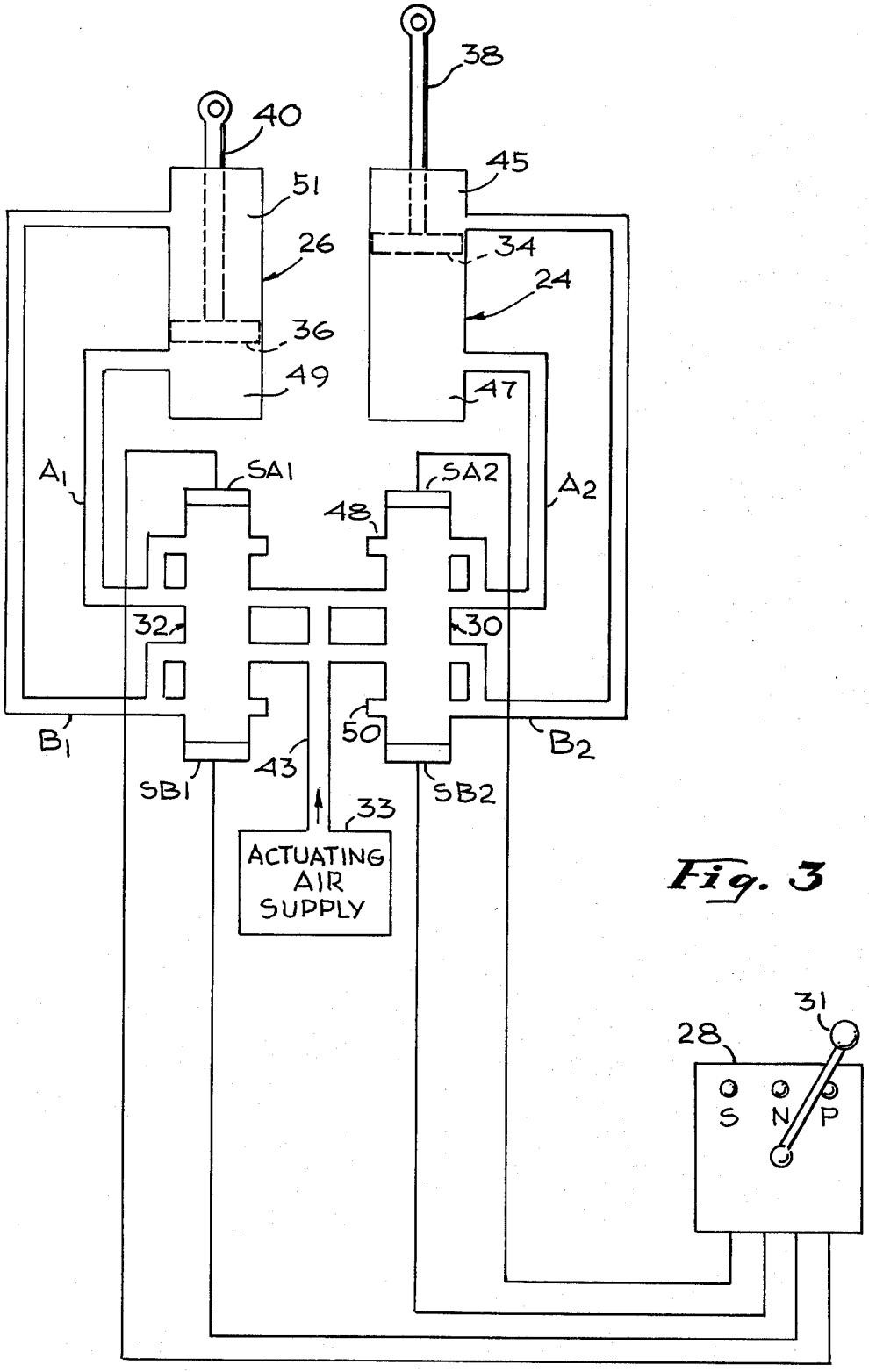
FIG. 3 is a schematic diagram of an open loop valve control system in accordance with the invention.

In accordance with the invention, FIG. 3 illustrates the open loop pneumatic positioning mechanism for actuators 24, 26. Control panel 28 is a conventional three position switching device which provides proper logic control for solenoids $SA_1$, $SA_2$, $SB_1$, and $SB_2$. The solenoids control first and second air valves 30,32 which in turn provide a pneumatic path from high pressure actuating air supply 33 to actuators 24, 26 via actuating air line 43 and pneumatic lines $A_1$, $B_1$, $A_2$, and $B_2$. Pistons 34, 36 of actuators 24, 26 are thereby displaced, moving actuating rods 38, 40 up or down dependent upon the state of air valves 30 32. Actuating rods 38, 40 are respectively coupled to vanes 20, 22 so that upward movement of the actuating rods 38, 40 rotates vanes 20, 22 about their respective axes 21, 23 to thus open the water flow paths through outlet pipes 17, 18. Downward movement of either rod 38, 40 rotates its repective vane 20 or 22 to close the water flow path associated therewith.

Valves 30 and 32 are conventional double solenoid four way air valves. Since valves 30 and 32 are substantially identical. The operation thereof will be described in terms of valve 30 with the understanding that the description applies equally to valve 32.

Solenoids $SA_2$ and $SB_2$ are energized or deenergized by signals from control panel 28. At any given time one of the solenoids will be energized and the other deenergized. The energized solenoid acts to push channeled spool 42, depicted in FIGS. 4*a, b,* and *c,* to the opposite end of valve 30, thereby connecting one of the pneumatic lines $A_2$ or $B_2$ through channel 44 or 46 to actuating air line 43. Pressurized air is thus supplied from actuating air line 43 to either the lower chamber 47 or the upper chamber 45 of pneumatic actuator 24. It should be noted that the chamber of actuator 24 which is not supplied with pressurized air is connected through its respective pneumatic line $A_2$ or $B_2$ to an exhaust port 48 or 50 in air valve 30. Thus, as one chamber of actuator 24 is pressurized, the other is vented to the atmosphere, allowing piston 34 to move to the desired position.

Figure 4A:
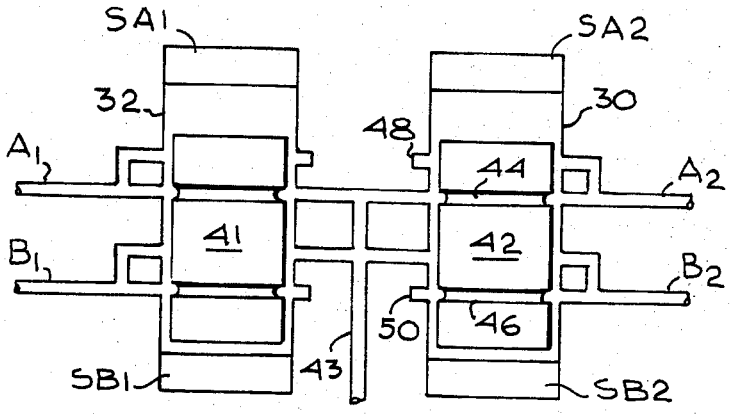
FIGS. 4*a*, 4*b*, and 4*c* depict the neutral, starboard and port thrust states of the positioning valves of FIG. 3.

FIGS. 4*a,* 4*b,* and 4*c* depict the condition of valves 30, 32 in each of the three allowable thrust states; i.e. neutral, starboard, and port thrust. An understanding of system operation is best acquired by consideration of FIG. 3 in conjunction with FIG. 4*a.* closed position and closing the flow path through thruster outlet pipe 17. The signals to solenoids $SA_1$ and $SB_1$ remain unchanged, therefore the port flow path remains open and the starboard thrust state is established. Transition from the neutral to the port thrust state is achieved in a similar manner.

Attention is now directed to control panel 28, depicted in FIG. 3. Panel 28 is designed such that a transition from the port to the starboard or from the starboard to the port thrust states can only be effected by passing control lever 31 through the N (neutral) position. Thus the transition is actually port-neutral-starboard or starboard-neutral-port. The significance of such sequencing is that both of vanes 20, 22 must go to the open position before either can be closed. The response time of the system is such that the vanes will always open before either can close regardless of the speed of movement of lever 31. It is thus assured that at least one flow path will be open at all times. Other embodiments of the invention could utilize electrical delay devices or hydraulic or pneumatic control means rather than control panel 28 to effect the sequencing described hereinabove.

Attention is now directed to TABLE A which denotes the condition of each solenoid, pneumatic line, piston and outlet pipe valve for each of the three allowable thrust states. It should be noted that a fourth possible state, wherein both of vanes 20, 22 are closed is prevented by the logic.

TABLE A

| THRUST DIR | $SA_1$ | $A_1$ | $SB_1$ | $B_1$ | $SA_2$ | $A_2$ | $SB_2$ | $B_2$ | PISTON 34 | PISTON 36 | STBD V. | PORT V. |
|---|---|---|---|---|---|---|---|---|---|---|---|---|
| NEUT. | 1 | + | 0 | − | 1 | + | 0 | − | UP | UP | OP | OP |
| STBD | 1 | + | 0 | − | 0 | − | 1 | + | DN | UP | CL | OP |
| PORT | 0 | − | 1 | + | 1 | + | 0 | − | UP | DN | OP | CL |

If control lever 31 of control panel 28 is moved to the "N" (neutral) position, solenoid $SA_2$ will be energized, driving the spool 42 to the (bottom) position remote therefrom within air valve 30. Actuating air line 43 will therefore supply high pressure air through channel 44 to pneumatic line $A_2$ which in turn supplies the high pressure air to lower chamber 47 of pneumatic actuator 24. Pneumatic line $B_2$ is simultaneously connected via channel 46 to exhaust port 50 providing an exhaust path from upper chamber 45 of actuator 24 to the atmosphere. Piston 34 and actuating rod 38 are thus forced upward thereby rotating valve 20 to the open position. Solenoid $SA_1$ will be similarly energized, driving spool 41 to the bottom position, thereby supplying high pressure air to lower chamber 49 of actuator 26 and venting upper chamber 51 to the atmosphere via pneumatic line $B_1$. Piston 36 and actuating rod 40 are thus driven upward, rotating vane 22 to the open position. Thus, the neutral (both flow paths open) state is achieved.

Assume now that the system is in the neutral thrust state shown in FIG. 4*a.* If control lever 31 is moved to the "S" (starboard thrust state) position, solenoid $SA_2$ is deenergized and $SB_2$ is energized, pushing spool 42 to the (top) position remote therefrom. Movement of spool 42 disconnects pneumatic line $A_2$ from actuating air line 43 and connects pneumatic air line $A_2$ to exhaust port 48. Simultaneously, pneumatic line $B_2$ is disconnected from exhaust port 50 and is connected to actuating air line 43. High pressure air is thus supplied to the upper chamber 45 of actuator 24, lower chamber 47 is vented via exhaust port 48, piston 34 is forced down and actuating rod 38 is retracted thus rotating vane 20 to the In TABLE A "1" or "0" represents the presence or absence of a solenoid energizing signal, "+" or "−" represents the presence or absence of pressure on an A or B pneumatic line, "UP" or "DN" (down) denotes the position of a piston (or actuating rod) and "OP" or "CL" (open or closed) denotes the position of a vane and therefore the condition of the flow path through a particular outlet pipe.

From TABLE A it is apparent that whenever an "SA" solenoid is enegized (1), the corresponding "A" pneumatic line is pressurized (+), the associated piston is up and the associated vane and flow path is open. Similarly, if any "SB" solenoid is energized, the associated vane and flow path is closed.

Figure 4B:
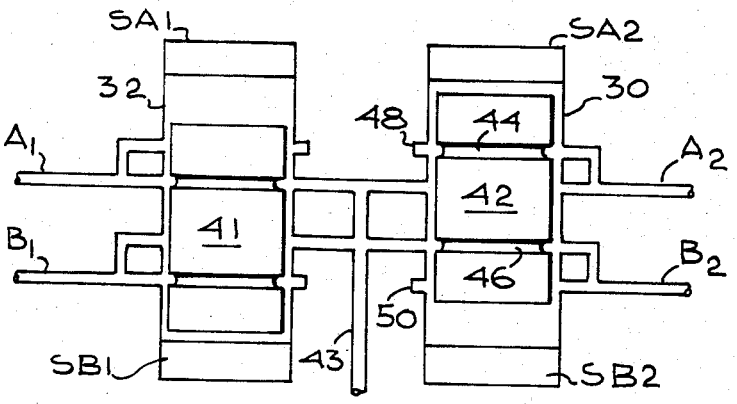
Figure 4C:
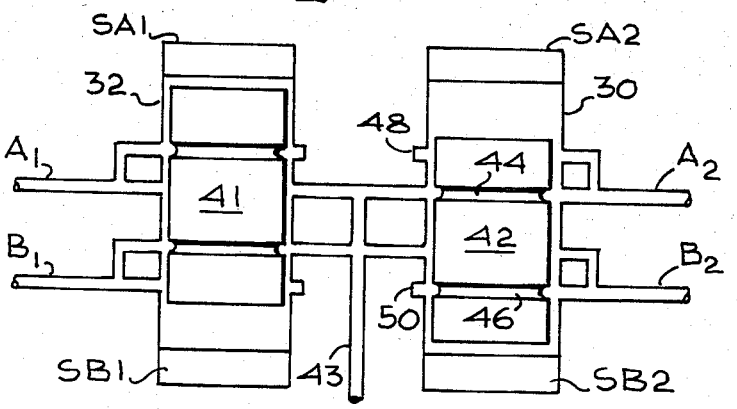

It should be apparent from TABLE A and the description thus far, that each of the vanes 20, 22 can only be in one of two distinct positions. That is, each vane can be either fully open (as depicted for vane 22 in FIG. 2) or fully closed (as depicted for vane 20 in FIG. 2). The control system depicted in FIGS. 3 and 4 assures that a vane cannot assume an intermediate partially open position.

Figure 5:
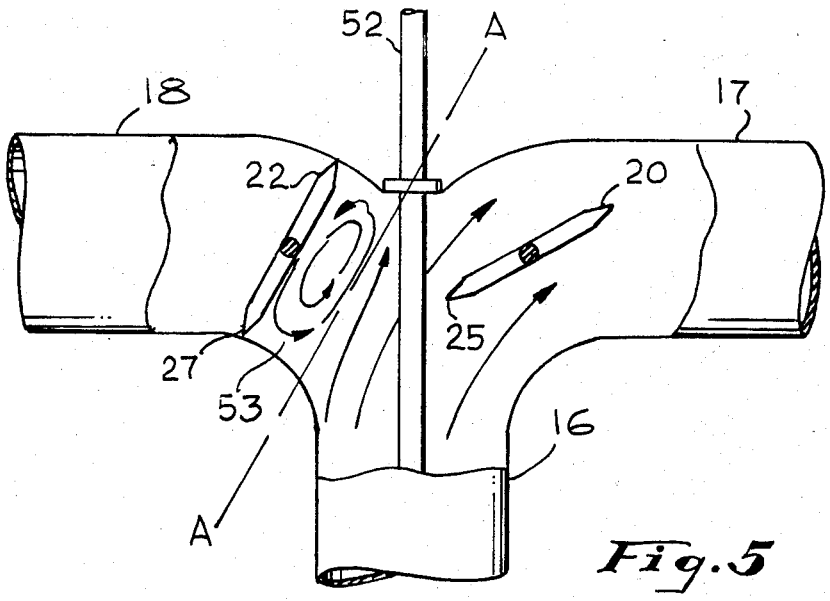
FIG. 5 is a front elevation view, partially broken away, of a basic prior art thruster system.

Attention is now directed to FIG. 5 which depicts a typical prior art thruster system. Shaft 52 extends substantially along the central axis of thruster pipe 16 to engage pump 12. Vanes 20,22 must therefore be located a sufficient distance into thruster outlet pipes 17, 18 to prevent the lower edges 25, 27 thereof from striking shaft 52 when vanes 20, 22 are moved from the closed to the open position; this, coupled with the requirement that the vanes be of sufficient size to completely close the water flow paths through outlet pipes 17 or 18 results in vanes 20, 22 being mounted at a position different from that which would produce minimum turbulence and maximize the energy in the water flow.

Because of the positioning requirements discussed hereinabove, a large dead water recirculation region 53 is produced between closed vane 22 and line A—A. Such a recirculation area, of course, takes energy from the water flow. It is, therefore, desirable to reduce the size of area 53 as much as possible. Additionally, vanes 20 and 22 are not mounted in a position to minimize turbulence in the water flow therepast when in the open position.

Figure 6:
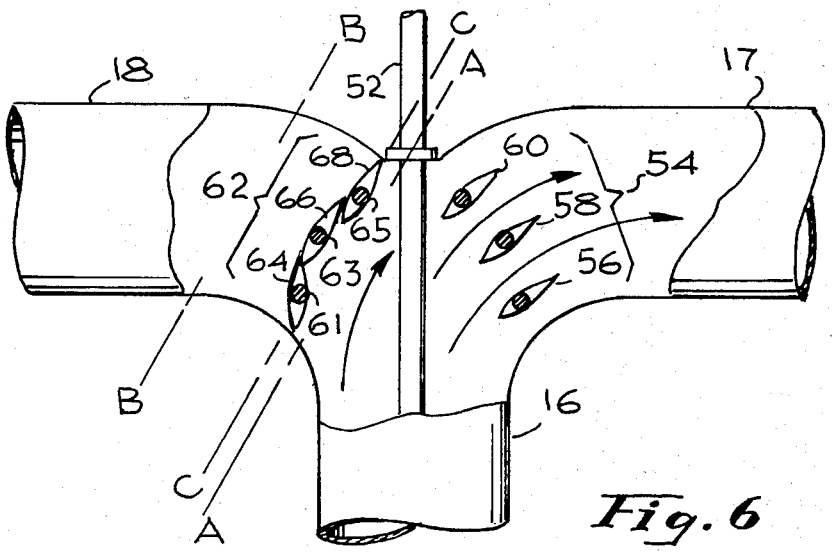
FIG. 6 is a front elevation view, partially broken away, of a thruster system employing multiple vane valves in accordance with the present invention.
Figure 7:
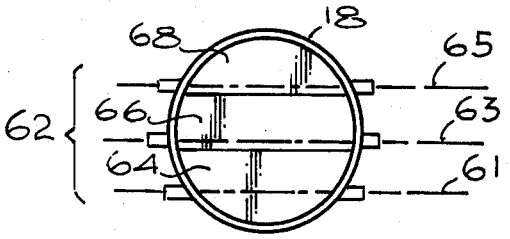
FIG. 7 is a sectional view along plane B—B of FIG. 6 depicting the valve in the closed position.

In accordance with the invention, FIGS. 6 and 7 depict an improved system wherein vane 20 is replaced by valve 54 which comprises three substantially planar vanes 56, 58, and 60 and vane 22 is replaced by valve 62 which comprises three substantially planar vanes 64, 66, and 68. Each of the vanes associated with valves 54 and 62 is mounted about a separate axis of rotation in a manner similar to vanes 20 and 22 and is rotated about said axis by actuating rods 38 and 40 to establish the hereinbefore described open and closed positions. Each of the vanes of valves 54 and 62 is mounted about its respective axis of rotation in an unbalanced manner; that is, a greater proportion of the surface area defined by each vane lies above the axis of rotation thereof than lies below.

Closed valve 62 is depicted in FIG. 6 and in FIG. 7 which is a view taken along plane B—B in FIG. 6. Vanes 64, 66, and 68 of valve 62 meet and overlap slightly to present a slightly concave face to the water flowing from pipe 16 into outlet pipe 18. Since each of vanes 64, 66, and 68 is only slightly more than one third the size of vane 22 and since the axis of rotation 61, 63, and 65 for each of vanes 64, 66, 68 respectively lies at a point below the midpoint of the vane when the vane is in the closed position, the vanes can be mounted much closer to shaft 52 than could vane 22, reducing the size of recirculation area 53 to approximately the area bound by lines A—A and C—C thereby reducing the energy losses in the water flow. Additionally, the concave face, formed by mounting vanes 64, 68 alone line C—C and mounting vane 66 at a point slightly offset therefrom as shown in FIG. 6, is known to be more effective than a planar face in directing water flow from pipe 16 into outlet pipe 17. Thus, the efficiency of the system is further enhanced. Vanes 56, 58, and 60 of open valve 54 may similarly be positioned nearer to shaft 52. Such positioning of the three vane arrangement is also more efficient in the open position than single vane 20 for reducing low pressure areas and turbulence in the flow path.

In the preferred embodiment, approximately 60% of the surface areas (and of the weight) of each vane lies above and 40% lies below the axis of rotation associated therewith. The reason for such unbalanced mounting is to provide means for establishing the open state for valves 54 and 62 in the event of mechanical or pneumatic failure in the positioning mechanism associated therewith. Since the force exerted upon the surface of a vane by the water flow is disproportionate about the axis of rotation of the vane, the vane will rotate about its axis from the closed to the open position unless its pneumatic valve is forcing it closed.

From the foregoing, it should be apparent that the present invention provides a novel and useful boat thruster system. It is recognized that different embodiments of the invention may now become obvious to those skilled in the art and the claims associated herewith are intended to include all such embodiments.

What is claimed is:

1. In combination with a boat having a hull, a thruster system including pump means mounted in said hull for pumping water, a common passage connected to said pump means and to first and second outlet means opening to the sea on either side of said hull for discharging water into the sea thereat, the improvement comprising:

a first vane means mounted in said first outlet means for movement between a fully open and fully closed position respectively permitting or prohibiting water flow through said first outlet means;

a first actuator coupled to said first vane means actuatable to independently force said first vane means to either said open or closed position;

a second vane means mounted in said second outlet means for movement between a fully open and fully closed position respectively permitting or prohibiting water flow through said second outlet means;

a second actuator coupled to said second vane means actuatable to independently force said second vane means to either said open or closed position;

control means for selectively establishing mutually exclusive first, second, and third states, said control means including means for selectively switching from any one state to any other state and for compelling the establishment of said third state during switching from said first to said second state and during switching from said second to said first state;

means responsive to said first state for causing said first actuator to force said first vane means to said fully closed position and said second actuator to force said second vane means to said fully open position;

means responsive to said second state for causing said second actuator to force said second vane means to said fully closed position and said first actuator to force said first vane means to said fully open position; and means responsive to said third state for causing said first and second actuators to respectively force said first and second vane means to said fully open position.

2. The system of claim 1 wherein said first actuator includes a piston coupled to said first vane means and said second actuator includes a piston coupled to said second vane means;

a pressure source; and wherein said control means includes means for coupling said pressure source to said first and second actuators to move the pistons thereof and thus move the vane means coupled thereto to either said fully open or fully closed position.

3. The system of claim 1 wherein:

said first vane means includes a first plurality of vanes mounted for rotation in said first outlet means;

said second vane means includes a second plurality of vanes mounted for rotation in said second outlet means; and each of said vanes is mounted for rotation about an axis displaced from the midpoint thereof and oriented so that water flowing from said pump means tends to rotate said vanes to said open position.

4. In combination with a boat having a hull, a thruster system including pump means mounted in said hull for pumping water to first and second outlet means opening on opposite sides of said hull and first and second independent actuators respectively operable to open or close first and second valves respectively located in said first and second outlet means, the improvement comprising:

said first valve including a first plurality of vanes mounted for rotation about an axis extending substantially perpendicular to the direction of flow in said first outlet means between a fully open position permitting water flow to said first outlet means and a fully closed position prohibiting water flow to said first outlet means;

means coupling said first actuator to said first valve means to selectively rotate said vanes to said fully open or fully closed positions;

said second valve including a second plurality of vanes mounted for rotation about an axis extending substantially perpendicular to the direction of flow in said second outlet means between a fully open position permitting water flow to said second outlet means and a fully closed position prohibiting water flow to said second outlet means;

means coupling said second actuator to said second valve vanes to selectively rotate said vanes to said fully open or fully closed position;

means eccentrically mounting at least one vane of said first plurality of vanes to enable water flowing from said pump means to open said vane in the absence of said first actuator operating to close said vane;

means eccentrically mounting at least one vane of said second plurality of vanes to enable water flowing from said pump means to open said vane in the absence of said second actuator operating to close said vane;

control means for selectively establishing mutually exclusive first, second, and third states, said control means including means for selectively switching from any one state to any other state and for compelling the establishment of said third state during switching from said first to said second state and during switching from said second to said first state;

means responsive to said first state for causing said first actuator to force said first valve vanes to said fully closed position and said second actuator to force said second valve vanes to said fully open position;

means responsive to said second state for causing said second actuator to force said second valve vanes to said fully closed position and said first actuator to force said first valve vanes to said fully open position; and means responsive to said third state for causing said first and second actuators to respectively force said first and second valve vanes to said fully open position.

* * * * *